United States Patent [19]

Cobb

[11] 4,017,255

[45] Apr. 12, 1977

[54] DYED TEXTILE MATERIALS

[75] Inventor: Malcolm Carnie Cobb, Ponthir, England

[73] Assignee: Imperial Chemical Industries, London, England

[22] Filed: May 20, 1974

[21] Appl. No.: 471,742

Related U.S. Application Data

[63] Continuation of Ser. No. 876,218, Dec. 1, 1969, abandoned, which is a continuation of Ser. No. 519,336, Jan. 7, 1966, abandoned.

[52] U.S. Cl. ..... 8/21 B; 8/168 B

[51] Int. Cl.[2] ..... D06P 3/854

[58] Field of Search ..... 8/21 B

[56] References Cited

UNITED STATES PATENTS

| | | | |
|---|---|---|---|
| 2,922,690 | 1/1960 | Mueller et al. | 8/26 |
| 2,989,798 | 7/1961 | Bannerman | 8/178 |
| 3,078,248 | 2/1963 | Ben | 280/78 R |
| 3,099,631 | 7/1963 | Tanner | 8/178 |
| 3,105,732 | 10/1963 | Ortheil | 8/21 B |
| 3,700,398 | 10/1972 | Cole | 8/21 B |

OTHER PUBLICATIONS

Taylor, J. Amer. Chem. Soc., Mar. 1947 pp. 635–639.
Shrolli, Man Made Fibers, Science & Technology, vol. p. 252.
Douglas, Amer. Dyestuff Rep. Feb. 19, 1951, pp. 122–126, TP890A512.
Schmidlen, Preparation and Dyeing of Synthetic Fibres., p. 176.

*Primary Examiner*—Donald Levy
*Attorney, Agent, or Firm*—Herbert M. Adrian, Jr.

[57] ABSTRACT

A process is described for manufacturing fibrous materials such as carpet yarns and textile yarns, wherein the yarns contain at least two groups of differentially dyeable nylon filaments. The fiber chemical structure of the filaments is altered so that groups of nylon filaments in the yarn have at least two distinctly different dyeability properties. Each group of nylon filaments has an anionic polymer group difference of at least 20 microequivalents per gram of polymer, thereby providing visible differences in dye uptake.

5 Claims, 1 Drawing Figure

DEPENDENCE OF EQUILIBRIUM DYE UPTAKE ON BATH pH FOR THE ACID DYE C.I. ACID BLUE 45 AND THE BASIC DYE C.I. BASIC ORANGE 28 ON YARNS A & B

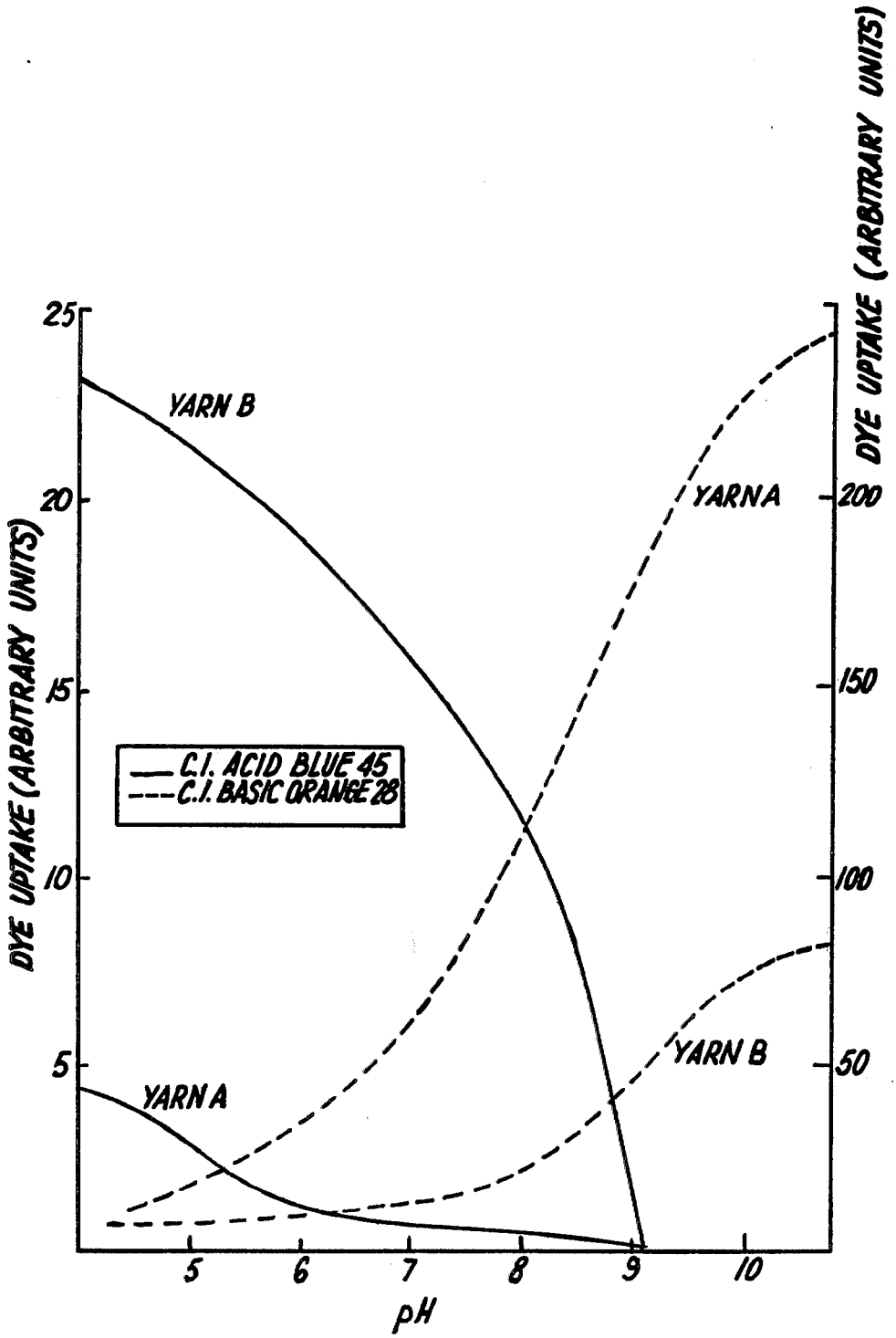
DEPENDENCE OF EQUILIBRIUM DYE UPTAKE ON BATH pH FOR THE ACID DYE C.I. ACID BLUE 45 AND THE BASIC DYE C.I. BASIC ORANGE 28 ON YARNS A & B

DYED TEXTILE MATERIALS

This application is a continuation of application Ser. No. 876,218 filed Dec. 1, 1969, now abandoned, which in turn was a continuation of application Ser. No. 519,336 filed Jan. 7, 1966, now abandoned.

The present invention relates to methods of dyeing textile materials comprising nylon filaments or yarns.

Nylon, that is to say polyamides such as polyhexamethylene adipamide and polycaprolactam in textile materials, whether in yarn or fabric form, has hitherto been dyed principally with dyes of two main types referred to respectively as acid dyes and disperse dyes.

Disperse dyes are substantially insensitive to variation in the chemical properties of the nylon polymer but acid dyes which carry anion-forming groups such as sulphonic acid or carboxylic acid groups rely for uptake upon the presence in the polymer of groups capable of forming cationic centres with which the anionic dyestuff molecule can become associated.

In present-day unmodified nylons, the cation-forming groups are amine groups at the ends of the polymer chains, but in modified nylons some cation-forming groups may be incorporated in the polymer chains or pendant to points along the lengths of the polymer chains. Methods for determining amine end group content (AEG content) do not discriminate between titratable basic groups at the ends of the polymer chains and titratable basic groups elsewhere along the lengths of the polymer chains, and for convenience the total content of titratable basic groups is referred to as "the amine end group content". As is explained in the article by G. F. Price in the book entitled "Techniques of Polymer Characterisation" edited by P. W. Allen and published in 1959 by Butterworths, AEG content is determined by titration in phenol-methanol solution by hydrochloric acid.

Even small changes in amine end group content reflect themselves in differences in acid dye uptake and by deliberately forming a textile material of nylon polymers of different amine-end-group contents a differentially-dyed textile material can be obtained by dyeing with an acid dyestuff and, in addition, if desired, with a disperse dyestuff which may be of the same or different hue.

The acid dyeing of nylon filaments or yarns of different amine end group contents so as to form differentially-dyed fabrics or yarns or other textile materials has been retarded because nylon polymers of high amine end group contents can only with considerable difficulty satisfactorily and economically be melt-spun on account of the pronounced tendency of such polymers to undergo oxidatively- and thermally-induced changes leading to gelling and dripping at the spinneret face.

Further, because uptake of a disperse dyestuff by nylon polymer is not prevented by previous dyeing of the polymer by an acid dyestuff (whether or not all available amine end groups have been exhausted) it is not possible by dyeing 'grey' materials with combinations of acid and disperse dyestuffs to obtain textile materials dyed in two primary colours. An example will make this clear. Suppose we have two yarns formed of polymers of markedly differing amine-end-group contents. Dyeing these yarns with, say, a yellow acid dyestuff could result in the one yarn being dyed yellow and the other yarn being dyed substantially not at all. To secure dyeing of the other yarn to another primary colour, say, blue a dye must be used that will not be taken-up by the already-dyed yarn but will be taken-up by the not-yet-dyed yarn. Clearly, a second acid dyestuff could not meet this requirement and a disperse dyestuff would not discriminate between the yarns so that, in the latter case, the result would be that one yarn would be dyed blue and the other yarn would change in colour to some shade of green.

The present invention provides a process for the manufacture of textile materials containing differentially dyed nylon filaments or yarns which comprises forming a textile material of filaments or yarns of which at least some, preferably all, are composed of nylon, and of which some of the nylon filaments or yarns are composed of a nylon having a different content of anion-forming groups, such as carboxy groups, from the nylon of which others of the filaments or yarns are composed, and dyeing the textile material with a dye liquor containing a cationic dyestuff, as herein defined, under such conditions, including a pH in the dye liquor of at least 6, as to dye the filaments of the different nylons to different extents. Thereafter, or simultaneously or prior to, dyeing with the cationic dyestuff, if desired, the textile material may be dyed with an acid or disperse dyestuff of some different colour. In this way two-colour textile materials are formed of which the colours can, where an acid and a cationic dyestuff are used and where the contents of anion — and cation-forming groups in the different nylon polymers are suitably related, be primary colours. Thus, to use the above-mentioned example to illustrate, if the dyed and not-yet-dyed yarns were treated with a blue cationic dyestuff, and, assuming (as is quite feasible — see, for example, Table 1 hereinafter) that the polymer richer in amine-end-groups were correspondingly poorer in carboxyl-end-groups and vice versa, such treatment could result in the not-yet-dyed yarn being dyed blue on account of its relatively high content of carboxyl-end groups and in the already-dyed yarn not being dyed any further on account of too low a content of carboxyl-end-groups. The result would be two yarns dyed to two different primary colours.

Many cationic dyestuffs are noted for a fullness and brightness of colour and tinctorial power unequalled by acid dyestuffs. Further, it is expected that, because the carboxyl-end-group content of a nylon polymer changes when a fabric formed of it is grey-set to a much lesser extent than does the amine-end-group content, less stripiness will be evident in a fabric formed of yarns with different histories when dyed solely with a cationic dye subsequently to grey-setting. In addition, since fabric laundering conditions are usually alkaline, acid dyestuffs are subjected to a severe test of their wash-fastness on laundering garments dyed with them, whereas cationic dyestuffs show maximum affinity on nylon at high pH and garments dyed solely with them should not in general suffer a substantial change in level of dyeing on laundering.

The manufacture of nylon polymers having substantial contents of anion-forming end groups, say carboxyl end groups, can be carried out in a number of ways. Where the nylon polymer is formed by reaction between a diamine and a diacid an adequate excess of the diacid may be employed. Alternatively, a substance may be incorporated in the polymer chain which carries an anion-forming substituent such as a sulphonic acid group. Yet again, amine end groups may be converted by oxidation into carboxyl end groups. In these contexts British Patent Specifications Nos. 682975, 901938 and 901939 are relevant.

The textile material may, of course, be of any type. It may be a yarn or fabric and of any of the known fabric types viz: woven, knitted or non-woven. An especially suitable fabric is a tufted or looped pile carpet.

The term "cationic dyestuff" is used primarily to denote a dyestuff which is free from anionic water-solubilising groups, such as sulphonic acid and carboxylic acid groups, and which contains at least one cationic group, that is to say a group, such as a quaternary ammonium group, which carries a positive charge but a dyestuff which, although containing some anionic water-solubilising groups, also contains more than the functional equivalent of such groups of cationic groups, may be found on trial to exhibit over-riding cationic properties and such a dyestuff is to be regarded for present purposes as a "cationic dyestuff". The said cationic dyestuffs may be members of any of the known dyestuff series. Preferably they are members of the azo (which may be monoazo or polyazo) anthraquinone, nitro, azamethine, methine (including polymethine) di- or tri-phenylmethane, or phthalocyanine series. Numerous such cationic dyestuffs are known and many are being widely used in the dyeing industry. If desired the dyestuffs, especially the dyestuffs of the azo or phthalocyanine series, can contain coordinately-bound copper, chronium, cobalt or nickel atoms.

As examples of classes of cationic groups which may be present in the dyestuffs there may be mentioned quaternary ammonium groups, phosphonium groups, sulphonium groups, isothiuronium groups and cyclammonium groups.

The quaternary ammonium groups are preferably groups of the formula:

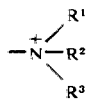

wherein $R^1$ represents a substituted or unsubstituted hydrocarbon radical or a primary, secondary or tertiary amino group, and $R^2$ and $R^3$ each independently represent substituted or unsubstituted hydrocarbon radicals, or at least two of $R^1$, $R^2$ and $R^3$ are joined or linked together to form with the nitrogen atom designated $N^+$ in the formula a 5- or 6-membered heterocyclic ring or rings wherein the nitrogen atom is linked to carbon atoms in the said heterocyclic ring or rings through single bonds, or two only of $R^1$, $R^2$ and $R^3$, (preferably $R^2$ and $R^3$), are present in the group and they are joined or linked together to form with the nitrogen atom designated $N^+$ in the formula a 5- or 6-membered heterocyclic ring in which the nitrogen atom is linked to carbon atoms in the heterocyclic ring through a single and a double bond.

The phosphonium groups are preferably groups of the formula:

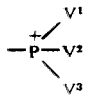

wherein $V^1$, $V^2$ and $V^3$ each independently represent alkyl, aralkyl or aryl radicals.

The sulphonium groups are preferably groups of the formula

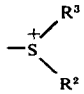

wherein $R^2$ and $R^3$ each independently represent substituted or unsubstituted hydrocarbon radicals.

The cyclammonium groups are preferably nitrogen-containing heterocyclic rings containing, as part of the ring system, a quaternised tertiary nitrogen atom and attached to the remainder of the dyestuffs molecule from some other position or positions in the ring. The cyclammonium groups can be derived from 6-membered and, above all, from 5-membered aromatic, nitrogen-containing heterocyclic rings, and preferably from a thiazole ring which, if desired, may form part of a condensed ring system such as the benzthiazole ring system. Typical examples of nitrogen-containing heterocyclic ring systems which on quaternisation contain a cyclammonium group are pyridine, pyrazole, imidazole, triazole, tetrazole, oxazole, thiazole, selenazole, oxadiazole, thiadiazole, pyrimidine, triazine, quinoline, indazole, benzimidazole, naphthimidazole, benzoxazole, benzthiazole, naphthathiazole and benzselenazole.

The isothiuronium groups are preferably groups which, in one of their resonating or canonical forms, are represented by the formula:

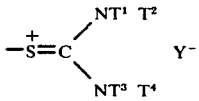

wherein Y represents an anion, and $T^1$, $T^2$ $T^3$ and $T^4$ each independently represent hydrogen atoms or substituted hydrocarbon radicals.

The or each cationic group may be directly attached to a carbon atom of an aromatic ring (preferably a benzene or a naphthalene ring) of the dyestuff molecule, or, better, the or each cationic groups may be attached to a carbon atom of an alkylene radical which is itself directly attached to a carbon atom of an aromatic ring of the dyestuff molecule, or which is attached to the aromatic ring through a divalent bridging atom or group. As examples of divalent bridging atoms and groups there may be mentioned —O—, —S—, —NH—, —N-alkyl, —CO—, —$SO_2$—, —CONH—, —NHCO—, —$SO_2$N-alkyl, —CONHCO—, OCOO— and —NHCONH—.

For specific examples of dyestuffs of the above-described general kinds reference may be had to British Patent Specifications Nos. 232740, 291888, 321155, 334706, 344409, 366964, 438603, 459594, 462238, 462296, 463042, 467983, 481942, 498012, 505839, 531489, 646888, 742112, 769163, 785988, 789263, 797144, 807241, 809224, 821001, 840282, 843644, 846562, 857391, 869794, 875995, 885521, 889374, 891907, 895240, 896681, 896972, 897195, 903007, 903994, 905030, 914074, 914075, 915139, 924563, 924601, 926998, 931118, 931557 and 944303.

Where dyeing with an anionic (acid) dye or a non-anionic (dispers) dye as well as by a cationic (basic) dye is to be carried out, the dyeing by the two types of dye need not be effected in any particular sequence and in given cases simultaneous dyeing may be possible. Optimum dyeing conditions can readily be determined by investigating how the equilibrium uptake of each dye varies with changing concentration of the dye in the dyebath and pH and temperature of the dyebath. Knowledge of the rate of dye uptake at given dye concentration may also be important. Such knowledge, coupled with simple trials to determine, for example, whether any additives, such as surfactants, buffering agents, and levelling agents which are desirably present or have as a matter of dye-house practice hitherto been employed when dyeing with a given dye have any adverse effect upon the dyeing behaviour or dyeing effect of another dye, will establish whether simultaneous dyeing by basic and acid or disperse dyes is possible The most suitable pH in the dyebath for dyeing with any given cationic dye will be within the range of pH of from 6 to 11, preferably 8 to 10. The uptake of disperse dyes is not in general greatly affected by changes in pH level in the bath.

It should perhaps be mentioned that cationic dyestuffs are increasingly being used as dyestuffs for acrylic fibres and yarns and that, for reasons peculiar to the acrylic art, dyebaths which are appreciably or strongly acidic are advocated. At such low pH values there will only be, at most, low uptake of cationic dyes by normal nylon.

Advantageously, the contents of anion-forming groups, for example carboxyl end groups, in the nylon polymers in the textile material differ one from another by at least 20 micro-equivalents per gram of polymer, although the higher the anion-forming-group content of the nylon polymer that is poorer in anion-forming groups the lesser will be the visual difference in level of dyeing between the different polymers for a difference in their anion-forming-group contents of say, 20 to 30 micro-equivalents per gram. Pronounced differences in cationic dye uptake are found when one polymer has say 20 to 30 micro-equivalents per gram of anion-forming groups and another has 90 to 110 microequivalents per gram of such groups with contents of cation-forming groups in approximately inverse correspondence. Textile materials containing such polymers may be dyed in the piece in two primary colours using a cationic dye and an acid dye.

The following experimental results exemplify and substantiate points made hereinbefore and assist in an understanding of the invention.

For the experiments, two yarns of substantially different amine- and carboxyl- end group contents were used. The relevant parameters of the yarns are given in the following Table 1.

TABLE 1

| Yarn | R.V. | A.E.G. | C.E.G. |
|---|---|---|---|
| A | 39.9 | 17.6 | 109.0 |
| B | 42.6 | 104.7 | 26.0 |

The yarns were prepared by autoclave reaction betwen adipic acid and hexamethylene diamine, one or other being in adequate excess, followed by further solid state polymerisation.

Pieces of grey knitted fabric containing the two yarns in approximately equal amounts were made up. First of all pieces of the fabric were dyed, some with a cationic dye and others with an acid dye, at different pH levels in the dye baths. The dyebath temperature in all cases was 95° C, and the period of dyeing was 3 hours. The concentration of dyestuff in all cases was 0.1% by weight calculated on the bath and the liquor/goods ratio was 400:1. The variations in dye uptake with pH that were observed are shown in graph form in the accompanying drawing. From the graph it can be seen that simultaneous dyeing by the two dyes at a dyebath pH of 8 – 8.5 is not only feasible but results in a fabric differentially dyed in two markedly different colours with a considerable uptake by respective yarns of respective dyes.

Further pieces of grey fabric were dyed with a large number of cationic dyestuffs most of which are commercially available and presently in use for dyeing acrylic fibres. The results are given in Table 2. The dyebaths were buffered by borate to an initial pH of 8.5, the dyeing was carried out at the boil for a period of 3 hours in all cases, and the fabric was present in the dyebath at liquor to goods ratio of 400 to 1. Yarn A always dyed to the darker shade except in the few cases stated where the contrast was so little as to be negligible.

The dyes referred to in Table 2 as Blue II and Turquoise III had the following formulae:

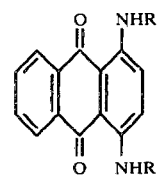

Blue II

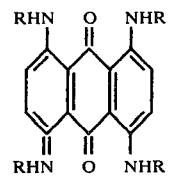

Turquoise III where R represents the group $-(CH_2)_3\,N^+CH_3(C_2H_5)_2\,I^-$

In Table 3 details are given of the relative dye uptake and light fastness ratings of pieces of the fabric when dyed with selected cationic dyes at pH 8.2 in the dyebath (borate buffered and maintained at the boil). The dye concentrations in the dyebath were 0.12 grams per liter and the liquor/goods ratio was 100:1 in all cases. Yarn B was dyed to a very weak colour in all cases.

Light fastness rating 5 indicates that testing was stopped after comparison sample of light fastness rating 5 had faded.

The two following examples illustrate how it is possible to obtain differential dyeing effects in two primary colours by dyeing from a single dye bath containing both an acid and a cationic dyestuff.

EXAMPLE A

A knitted fabric was formed that contained equal quantities of yarn A and yarn B referred to hereinbefore and the fabric was dyed in a dye bath containing 0.1 percent by weight (based on the bath) of the acid dye CI Acid Blue 45 (constitution No. 63010) and 0.1 percent by weight (based on the bath) of the cationic dyestuff CI Basic Red 18. The dye bath was phosphate buffered pH 8 and was maintained at a temperature of 95° C. The dyeing period was 1 hour and the liquor/goods ratio was 400:1. In the resultant dyed fabric, yarn A was dyed red and yarn B was dyed blue. The colours were substantially pure.

EXAMPLE B

Example A was repeated using the dyes CI Acid Red 13 (constitution No. 16045) and CI Basic Yellow 24 instead of the blue and red dyes mentioned therein. Otherwise all experimental details were the same as those given in Example A. The result was that yarn A was dyed yellow and yarn B was dyed red. The absence of any reddening of the yellow colour of yarn A was most striking.

TABLE 2

Behaviour of basic dyes (light fastness ratings LF are related to geometric scale 1-8 as described in B.S.S. 1006, 1955)

| DYE | COLOUR INDEX DYE NO. (CI BASIC) | COLOUR INDEX CONSTITUTION NUMBER | DYED 0.05% CONTRAST | DYESTUFF FINAL pH | DYESTUFF LF |
|---|---|---|---|---|---|
| Blue II | — | — | v. slight | 8.45 | 5–6 |
| Turquoise III | — | — | moderate | 8.50 | 4–5 |
| Cationic dyes for acrylic fibres | | | | | |
| Astrazone (F. Bayer | | | | | |
| Red GTL | Red 18 | — | good | 8.35 | >6 |
| BBL | Red 23 | — | slight | — | >6 |
| FG | — | — | good | — | <1 |
| 6B | Violet 7 | 48020 | good | — | 2 |
| Red Violet FRR | Violet 20 | — | good | — | 2 |
| Pink BL | — | — | moderate | — | <1 |
| FG | Red 13 | 48015 | v. good | — | <1 |
| Orange RRL | Orange 28 | — | good | — | 4–5 |
| Yellow GLD | — | — | not appreciable | — | 4 |
| 7GLL | Yellow 21 | — | v. good | 8.40 | 3 |
| 3G | Yellow 11 | 48055 | good | — | 3 |
| 5G | Yellow 12 | 48065 | good | — | 3 |
| Olive Green BL | Green 6 | — | good | — | 3–4 |
| Blue BRL | — | — | not appreciable | — | >6 |
| FGL | Blue 44 | — | good | 8.45 | >6 |
| Black M | — | — | good(Yarn A black yarn B dark brown) | — | 2–3 |
| Basacryl (B.A.S.F.) | | | | | |
| Red GL | Red 29 | — | good | 8.30 | 2 |
| Red 729 | — | — | good | — | 3 |
| Yellow 5GL | Yellow 24 | — | moderate | 8.40 | 4 |
| 5RL | Yellow 25 | — | moderate | — | >6 |
| Deorlene(CIBA) | | | | | |
| Brilliant Red R | Red 27 | — | good | 8.40 | 3 |
| Yellow 3R | Yellow 22 | — | not appreciable | 8.25 | 3 |
| Blue E5G | Blue 3 | 51005 | slight | 7.75 | 3 |
| Brilliant Blue RL | Blue 50 | — | v. weak dyeing | — | 1 |
| Sevron(du Pont) | | | | | |
| Brilliant Red 4G | Red 14 | — | good | — | 1–2 |
| B | Red 15 | — | good | 8.30 | 2 |
| Yellow L | Yellow 13 | — | v. weak dyeing | 8.30 | 2 |
| Blue BGL | Blue 35 | — | not appreciable | 8.45 | 2 |

TABLE 3

Behaviour of selected basic dyes

| Dye | Yarn | Relative dye uptake | LF Rating |
|---|---|---|---|
| Astrazone Red GTL | A | 100 | >5 |
| | B | 12 | 3–4 |
| Astrazone Blue FGL | A | 100 | >5 |
| | B | 26 | >5 |
| Astrazone Orange RRL | A | 100 | >5 |
| | B | 13 | 4–5 |
| Basacryl Yellow 5GL | A | 100 | 3–4 |
| | B | 29 | 3 |
| Basacryl Yellow 5RL | A | 100 | >5 |
| | B | 31 | >5 |

What we claim is:

1. A process for the manufacture of fiber materials containing at least two groups of differently dyed nylon filaments which comprises forming a fiber structure of filaments of which at least some are composed of nylon, said nylon filaments being of two distinct types in which a first type is composed of a nylon having a substantially homogeneous equal content of about 90 to 110 microequivalents per gram of carboxyl end groups and an amine end group content of about 20 to 30 microequivalents per gram, a second type of fiber composed of nylon having a substantially homogeneous equal content of about 20 to 30 microequivalents per gram of carboxyl end groups and about 90 to 110 microequivalents of amine end groups, said difference is carboxyl end group content between said two nylons being at least about 60 microequivalents per gram of polymer, and dyeing the fiber structure with a dye liquor containing a cationic dyestuff, under such conditions, including a pH in the dye liquor of at least 6, that said cationic dyestuff dyes said first and second types of filaments to different extents.

2. A process as set forth in claim 1 in which all the filaments and yarns in said textile material are nylon.

3. A process as claimed in claim 1 wherein the textile material is also dyed with an acid or disperse dyestuff of a different color.

4. A process as claimed in claim 1 wherein the textile material is simultaneously dyed with an acid and a cationic dyestuff.

5. The process of claim 1 wherein the fiber material is in the structure of a carpet.

* * * * *